United States Patent [19]

Pearcy

[11] Patent Number: 4,966,279

[45] Date of Patent: Oct. 30, 1990

[54] BUOYANT RECEPTACLE

[76] Inventor: Frank H. Pearcy, 4212 Beethoven, St. Louis, Mo. 63116

[21] Appl. No.: 447,923

[22] Filed: Dec. 8, 1989

[51] Int. Cl.[5] ..... B65D 85/00

[52] U.S. Cl. ..... 206/315.11; 206/459; 441/32; 190/100; 190/109; 190/111; 190/115; 190/117; 383/40; 383/18

[58] Field of Search ..... 190/102, 109, 110, 111, 190/112, 127, 100, 115, 117; 206/232, 459, 315.11; 441/1, 32; 383/38, 40, 15, 18, 19

[56] References Cited

U.S. PATENT DOCUMENTS

| | | | |
|---|---|---|---|
| 59,228 | 10/1866 | Jarrett | 441/32 |
| 1,359,461 | 11/1920 | Luce | 383/15 |
| 1,400,499 | 12/1921 | Henderson | 383/15 |
| 2,062,693 | 12/1936 | Balko | 441/32 |
| 2,515,715 | 7/1950 | Jones | 441/32 |
| 2,540,165 | 2/1951 | Fiel | 190/111 |
| 2,844,141 | 7/1958 | Daugherty | 190/111 |
| 3,159,930 | 12/1964 | Allen et al. | 206/459 |
| 3,708,045 | 1/1973 | Katz | 190/115 |
| 3,870,132 | 3/1975 | Hanley | 190/109 |
| 3,933,229 | 1/1976 | Pelavin | 190/111 |
| 3,963,102 | 6/1976 | Carp | 190/110 |
| 4,116,310 | 9/1978 | Shields | 383/40 |
| 4,210,186 | 7/1980 | Belenson | 383/18 |
| 4,212,377 | 7/1980 | Weinreb | 190/110 |
| 4,236,615 | 12/1980 | Ginat | 190/111 |
| 4,334,601 | 6/1982 | Davis | 190/111 |
| 4,773,515 | 9/1988 | Kotkins, Jr. | 190/103 |
| 4,805,748 | 2/1989 | Gerch | 190/103 |
| 4,805,749 | 2/1989 | Gerch | 190/112 |
| 4,840,497 | 6/1989 | Harber et al. | 206/459 |

*Primary Examiner*—David T. Fidei

*Attorney, Agent, or Firm*—Senniger, Powers, Leavitt & Roedel

[57] ABSTRACT

A tote bag made of cloth having a compartment at the bottom holding a block of buoyant material for flotation of the bag, the compartment having an opening for insertion of the block with a slide fastener for closing the opening, the block being rigid and holding the bottom of the bag flat, the bag being adapted to float with the compartment generally upright one way or the other and having distress signals on the bottom of the compartment arranged so that a signal is upright and visible above water whichever way the compartment is disposed.

5 Claims, 4 Drawing Sheets

BUOYANT RECEPTACLE

BACKGROUND OF THE INVENTION

This invention relates to buoyant receptacles, and particularly to a buoyant tote bag.

The invention is especially concerned with a tote bag for fishermen to carry on a boat, the bag being buoyant so that it may float if it should be dropped overboard to facilitate returning it.

SUMMARY OF THE INVENTION

Among the several objects of the invention may be noted the provision of a receptacle comprising a tote bag suitable for use as above described and having the feature of being capable of floating if dropped into the water, the receptacle being of practical and economical construction.

Generally, a receptacle of this invention comprises a tote bag having a generally rectangular bottom, upwardly extending sides and ends with an access opening, means for closing the opening, and handle means for carrying the bag. Means is provided for enabling the bag to float in the event it is dropped into the water comprising a compartment at the bottom of the bag having a generally rectangular bottom and sides and ends extending up to the bottom of the bag, the latter constituting the top of the compartment, and buoyant material in the compartment, the compartment having an opening through which the buoyant material is inserted and means for closing the opening after insertion thereof.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
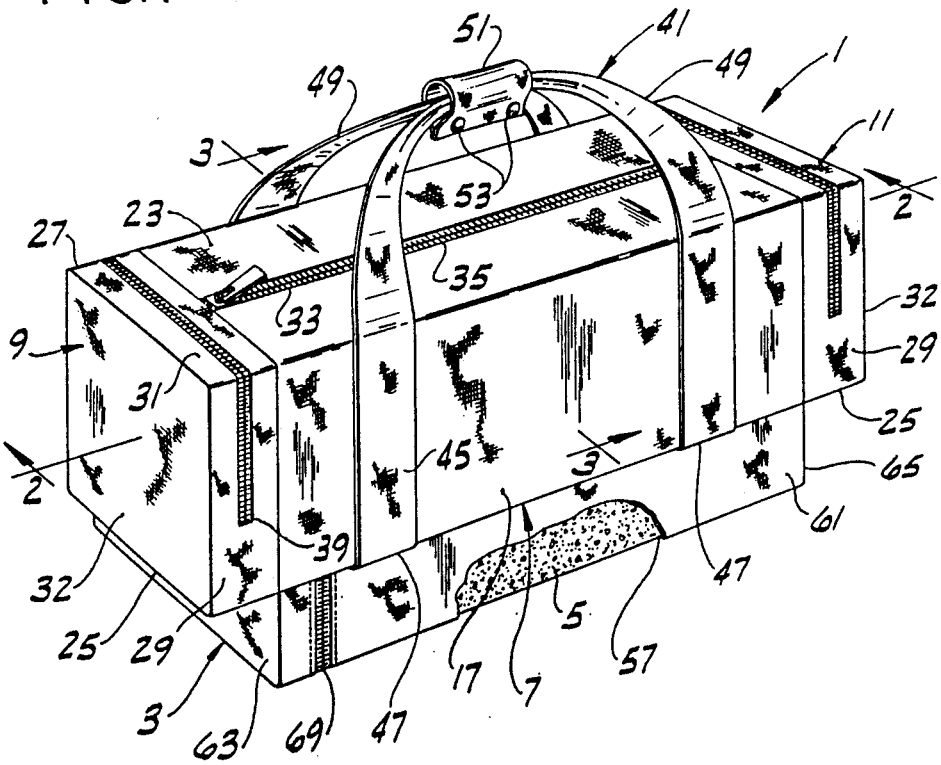
FIG. 1 is a perspective view of a receptacle of this invention, partly broken away to show the aforesaid buoyant material.
Figure 2:
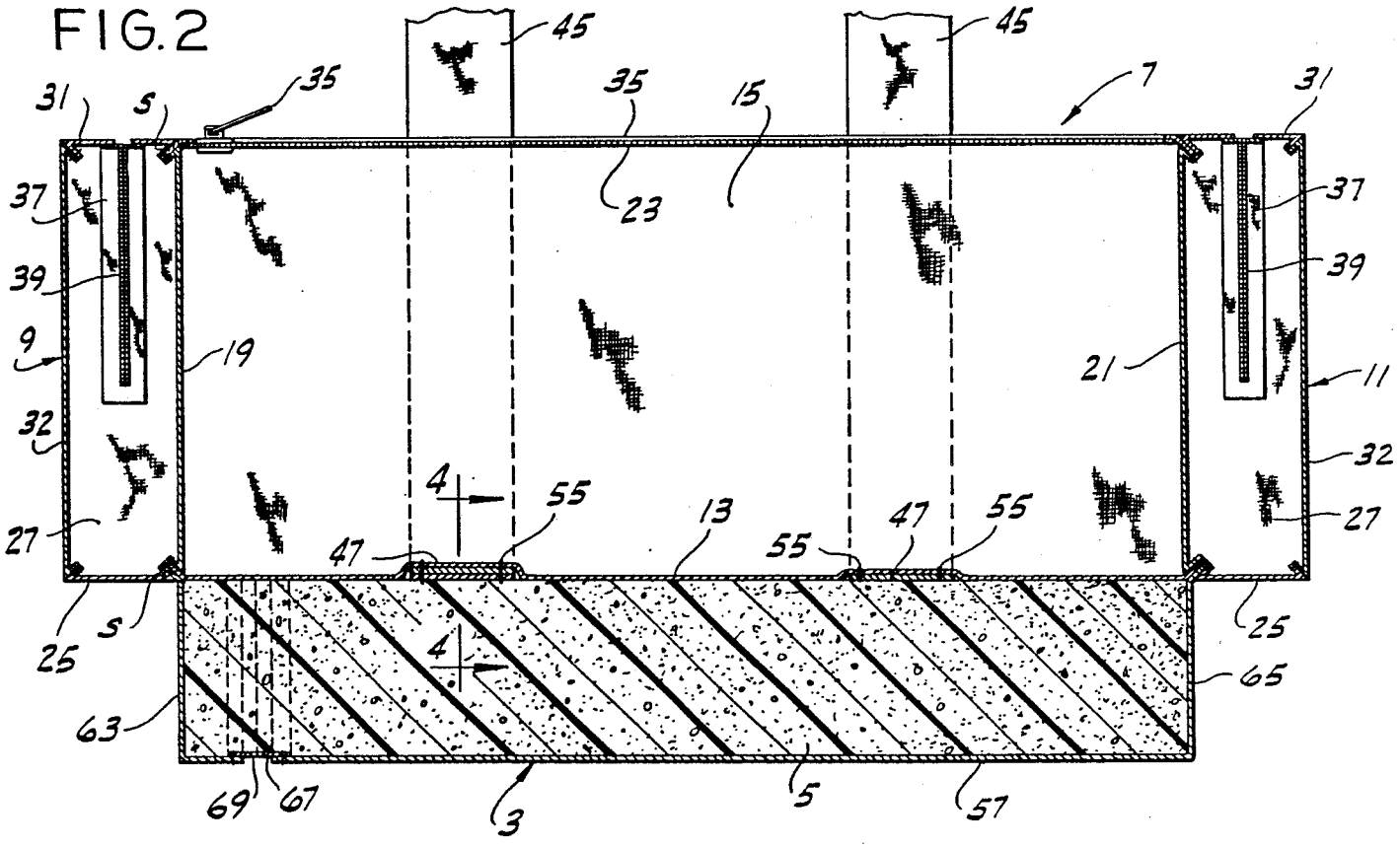
FIG. 2 is a vertical longitudal section through the said bag and its said compartment generally on line 2—2 of FIG. 1.
Figure 3:
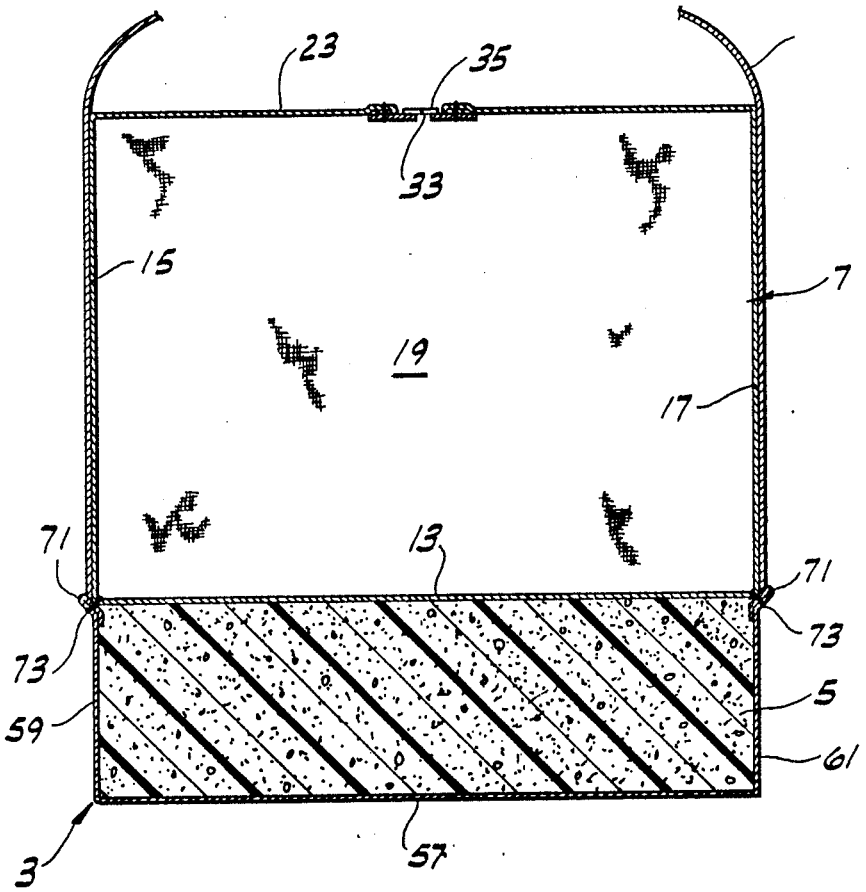
FIG. 3 is a transverse section generally on line 3—3 of FIG. 1.

Referring to the drawings, a buoyant receptacle of this invention is shown to comprise a tote bag generally designated 1 with a compartment 3 at the bottom holding buoyant material 5 making the entire receptacle capable of floating to facilitate retrieving it in the event it should fall into the water. The tote bag 1, which is preferably made of suitable cloth material although it may be made of other material, comprises an elongate main body 7 and pockets 9 and 11 at the ends of the main body. The main body has a generally rectangular bottom 13, upwardly extending sides 15 and 17, upwardly extending ends 19 and 21, and a generally rectangular top 23. The end pockets are secured as by stitching such as indicated at S at the ends of the main body, each having a bottom 25, sides 27 and 29 and a top

Figure 4:
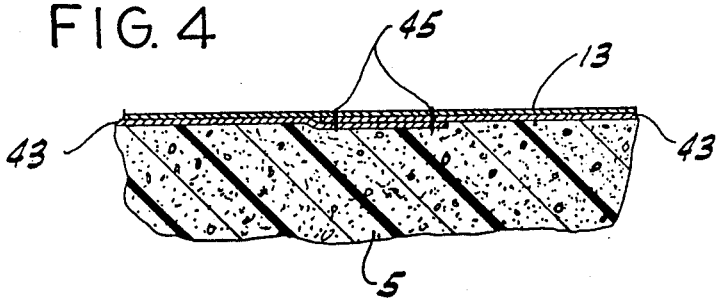
FIG. 4 is a vertical section on line 4—4 of FIG. 2.

31 in continuation of the bottom 13, sides 15, 17 and top 23 of the main body 7 of the bag, and an outside wall 32. The ends 19 and 21 of the main body form, in effect, partitions between the main body and the end compartments or pockets. The main body has an elongate longitudal opening at 33 for placement of items therein and removal of items therefrom with means constituted by a slide fastener 35 for closing the opening. Each of the end pockets 9 and 11 has an opening 37 extending transversely with respect to the bag across its top and down its sides for access thereto, with means constituted by a slide fastener 39 for closing each opening 37. Handle means 41 is provided for carrying the bag, this handle means comprising an elongate length of strapping 43, e.g. woven strapping, having its ends stitched together as indicated at 45 in FIG. 4 and disposed with two reaches thereof each designated 47 extending underneath the bottom of the main body of the bag spaced lengthwise of the bottom and two loops each designated 49 one extending up on the opposite sides of the bag, and hand grip means such as indicated at 51 having snap fastener means as indicated at 53 being provided for releasably securing the two loops together at the top. The strapping is stitched to the bag as indicated at 55.

The buoyancy compartment 3, which is preferably made of the same material as the tote bag 1 has a generally rectangular bottom 57 corresponding in size and shape to the bottom 13 of the main body 7 of the bag, sides 59 and 61 extending up to the sides 15 and 17 of the main body and ends 63 and 65 extending up to the ends 19 and 21 of the main body. The bottom 13 of the main body consitutes the top of the compartment 3. The latter is provided with an opening at 67 which extends down one side, across the bottom and up the other side, means constituted by a slide fastener 69 being provided for closing the opening. Buoyant material 5, preferably a block of closed cell rigid foamed plastic material such as that having an R rating sold under the trade name Ethafoam by Foam Products Corp. of St. Louis, Missouri, is lodged in the compartment 3, being inserted through the opening at 67 after which the slide fastener 69 is closed. The block 5 has a length corresponding generally to the length of the bottom 13 of the main body of the tote bag and the length of the bottom 57 of compartment 3, a width corresponding generally to the width of each of the bottoms 13 and 57, and a thickness (height) corresponding generally to the height of the compartment 3. Being so dimensioned, it has a relatively tight fit in the compartment and, being rigid, it stiffens the bottom 13 of the main body of the bag and holds it flat.

Figure 5:
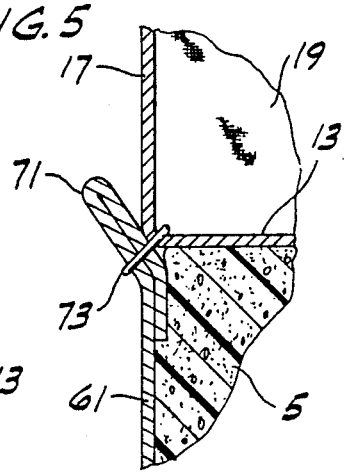
FIG. 5 is an enlarged fragment of FIG. 2.
Figure 6:
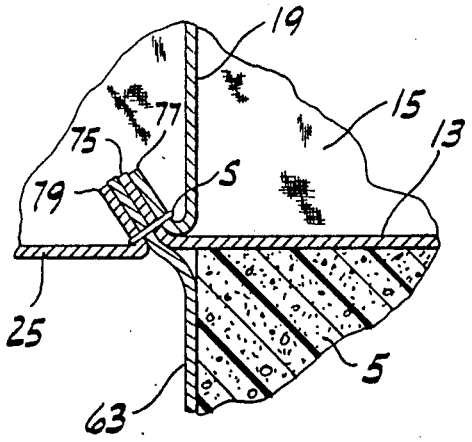
FIG. 6 is an enlarged fragment of FIG. 3.

As illustrated in FIG. 5, the sides 59, 61 of the buoyancy compartment 3 may be secured to the bottom of the main body 7 of the bag by doubling the upper margins of the sides as indicated at 71 and stitching the doubled margins to the junctures of the sides 15 and 17 and bottom 13 of the main body as indicated at 73. The strapping extends between the upper margins of the sides and the junctures. The ends 63, 65 of the compartment 3 may be secured to the ends of the bottom 13 of the main body 7 of the bag by stitching them as indicated at S at their upper margins between the margins of the respective end 75 of the bottom 13 of the main body and of the lower margin 77 of the respective end 19 of the main body and the upturned margin 79 of the bottom 25 of the respective pocket.

Figure 7:
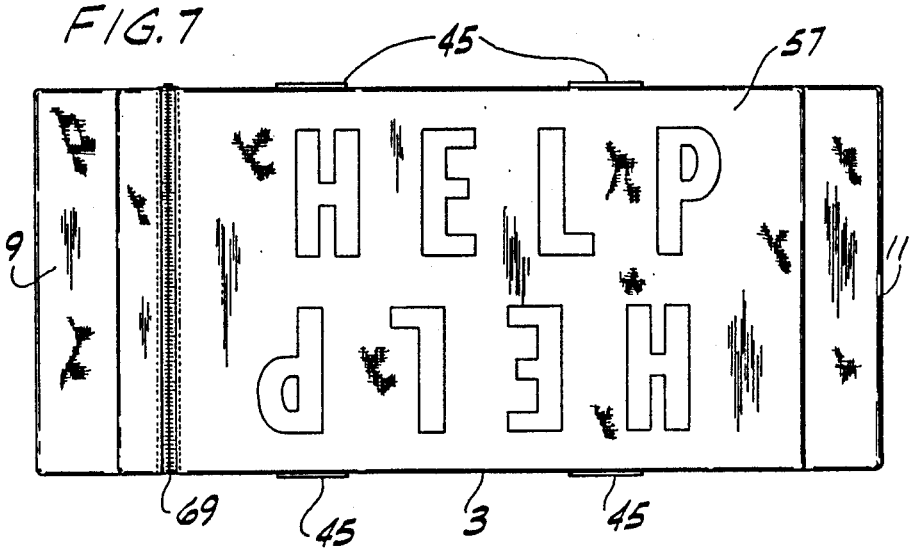
FIG. 7 is a bottom view.

With the block of the buoyant lightweight foam in the compartment, the receptacle (tote bag/and compartment 3) is buoyant and capable of floating if dropped in the water so that it may be readily retrieved. In a typical receptacle, the block is of so dimensioned as to have a displacement such as to float a load up to thirty-five pounds. As shown in FIG. 7, the receptacle is provided on the bottom 57 of the compartment 3 with distress signals, more particularly a first and a second word HELP, the first arranged to be upright when the compartment is upright one way on one long edge, the other reversely arranged so as to be upright when the compartment is upright the other way on its other long edge. With typical loads, the receptacle will float with the compartment generally upright one way or the other and with one of the words HELP above water (and upright).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A receptacle particularly for toting items on a boat comprising a tote bag having a main body made of cloth having a generally rectangular bottom, upwardly extending sides and ends and a generally rectangular top, the top having an access opening for placement of items in the bag on said bottom, and means for closing the opening, handle means for carrying the bag comprising strapping extending under and across the bottom of the main body of the bag and means for releasably fastening the strapping together above the bag, and means for enabling the bag to float in the event it is dropped into the water comprising a compartment at the bottom of the bag formed of cloth having a generally rectangular bottom corresponding in size and shape to the bottom of the main body, and sides and ends extending up to the sides and ends of the bottom, the upper margins of the sides of the compartment being seamed to the junctures of the sides and bottom of the bag, the strapping extending between the upper margins of the sides of the compartment and said junctures, the upper margins of the ends of the compartment being seamed to the junctures of the ends and bottom of the bag, the bottom of the bag forming the top of the compartment, a generally rigid block of buoyant material in the compartment, said block being rectangular in plan corresponding generally in size and shape to the bottom of the main body of the bag and the bottom of the compartment and having a thickness corresponding generally to the height of the compartment and thereby having a relatively tight fit therein, said block functioning to stiffen the bottom of the main body of the bag and hold it flat, said compartment having an opening through which the block of buoyant material is inserted, and means for closing the opening after insertion of the block.

2. A receptacle as set forth in claim 1 wherein the opening of said compartment extends across the bottom and up the sides thereof adjacent one end thereof.

3. A receptacle as set forth in claim 1 wherein the upper margins of the sides of the compartment are doubled and stitched to the junctures of the sides and bottom of the bag.

4. A receptacle as set forth in claim 1 having pockets on the outside of said ends each having a bottom stitched to the respective end of the bottom of the main body, sides and an outside wall, the upper margins of the ends of the compartment being stitched in between the ends of the bottom of the main body and the bottoms of the pockets.

5. A receptacle as set forth in claim 1 wherein first and second distress signals are provided on the bottom of the compartment, one arranged to be upright and visible above the water when the receptacle is floating with the compartment generally upright one way and the other arranged to be upright and visible above the water when the receptacle is floating with the compartment generally upright the other way.

* * * * *